United States Patent [19]

Rossi

[11] 3,945,424

[45] Mar. 23, 1976

[54] METHOD OF STRAIGHTENING A CONTINUOUSLY CAST STRAND

[76] Inventor: Irving Rossi, Dunros Farm, James St., Morristown, N.J. 07960

[22] Filed: Jan. 3, 1974

[21] Appl. No.: 430,576

[52] U.S. Cl. ..... 164/89; 164/283 S
[51] Int. Cl.[2] ..... B22D 11/124
[58] Field of Search ..... 164/82, 89, 283 R, 283 S

[56] References Cited

UNITED STATES PATENTS

| | | | |
|---|---|---|---|
| 2,726,430 | 12/1955 | Rossi et al. | 164/89 X |
| 3,339,623 | 9/1967 | Rys et al. | 164/89 X |
| 3,358,744 | 12/1967 | Rossi | 164/283 S X |
| 3,542,115 | 11/1970 | Rossi | 164/82 |
| 3,656,536 | 4/1972 | Colombo | 164/89 |

*Primary Examiner*—R. Spencer Annear
*Attorney, Agent, or Firm*—Nichol M. Sandoe

[57] ABSTRACT

In a continuous casting process in which a partially solidified strand of rectangular cross section is formed continuously in a water cooled mold and comprises upper and lower curved surfaces of different radii, and in which the said strand is curved and follows a curved path through a secondary cooling zone, the curved strand is straightened by applying cooling water to the curved surface of the strand which is of greater radius at an intensity sufficient to reduce the surface temperature thereof below the surface temperature of the surface of lesser radius to produce a temperature differential between said surfaces sufficient to straighten the strand.

4 Claims, 1 Drawing Figure

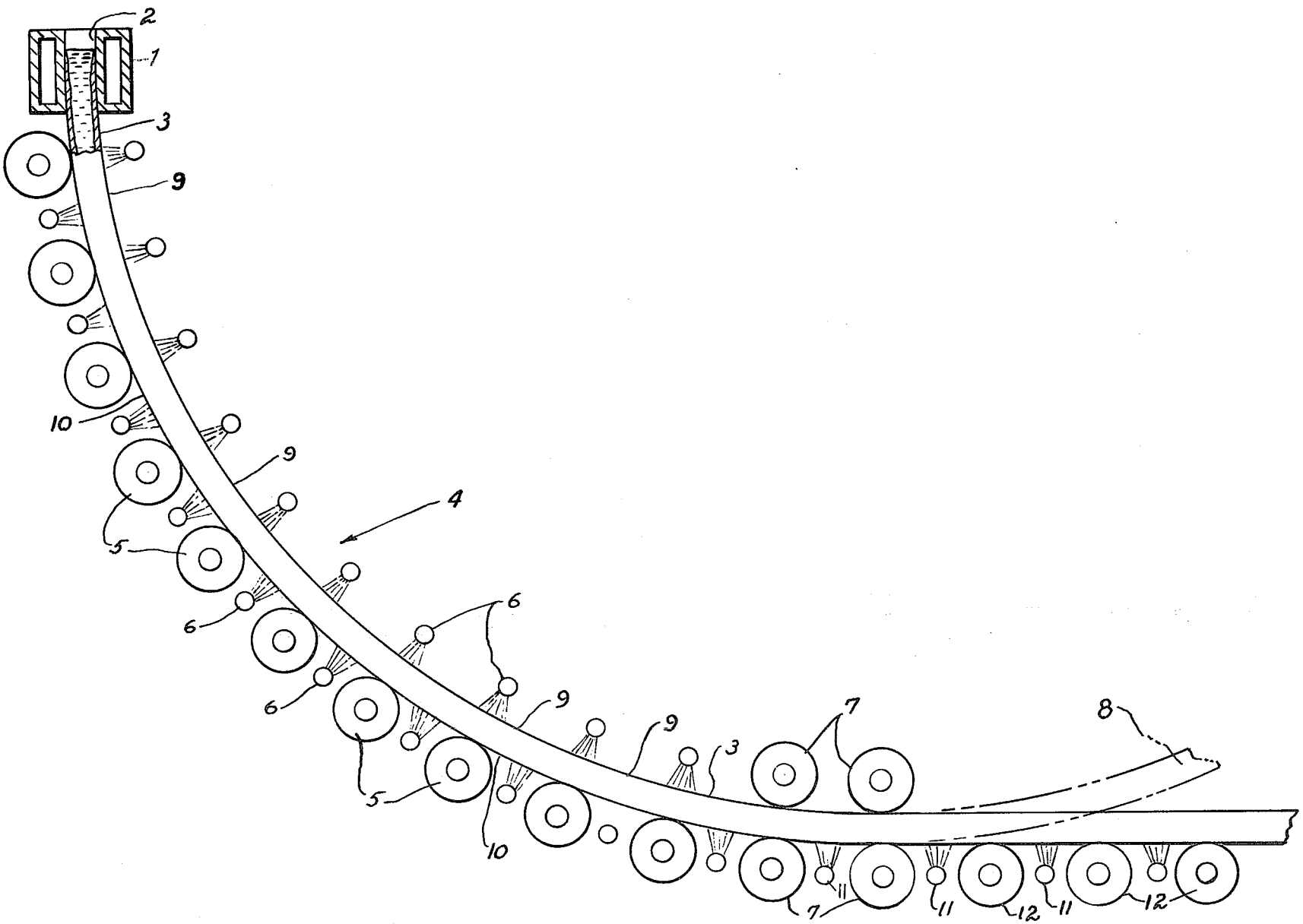
1
2
3
4
5
6
7
8
9
10
11
12

METHOD OF STRAIGHTENING A CONTINUOUSLY CAST STRAND

This invention relates to continuous casting, and pertains more particularly to the continuous casting of steel strands of substantially rectangular cross section such as slabs or billets. The techniques used in the casting of steel are different from those used in the casting of non-ferrous metals, because of the high temperature of molten steel and the large quantity of heat which must be removed to produce complete solidification of the cast strand.

In typical continuous steel casting machines, molten metal is poured continuously into the open upper end of a water cooled mold having a mold passage extending therethrough, and a partially solidified strand is withdrawn continuously from the lower end of the mold. The said strand consists of an outer solidified shell enclosing a still molten interior, sometimes referred to as a core or crater. As the strand emerges from the mold, it is guided into what is commonly referred to as a secondary cooling zone where cooling water is applied directly to the outer shell, usually in the form of high velocity jets. As the strand progresses through the secondary cooling zone and heat is withdrawn and dissipated by the cooling water the outer shell thickens gradually until the molten interior is completely solidified, after which the strand is cut into desired lengths.

In typical continuous steel casting machines, the path of the strand through the secondary cooling zone is curved in order to reduce the overall height of the machine. Thus, the strand, which emerges from the mold in a substantially vertical direction, follows a curved path through the secondary cooling zone until it is straightened to cause it to move in a substantially horizontal direction. The desired curvature may be introduced into the strand either by the use of a mold having a curved mold passage as in U.S. Pat. No. 2,947,075, or by bending the strand after it emerges from a mold having a straight mold passage as in U.S. Pat. No. 2,920,359.

In either event, in typical continuous steel casting machines the strand must be straightened before it reaches the cutting station where it is cut to provide pieces of lengths desired for further processing. It is usually straightened by a bank of straightening rolls usually comprising at least one pair of fulcrum rolls, one pair of bending rolls and one pair of reaction rolls such, for example, as disclosed in U.S. Pat. No. 3,752,210. In typical machines such straightening rolls must be large and heavy and must be mounted in heavy bearings capable of withstanding the heavy stresses involved in straightening steel strands of from 4 in. to 12 in. in thickness.

It is an object of the present invention to eliminate the need for straightening rolls, and to straighten the strand by thermal methods, i.e. by applying coolant in such manner as to induce thermal stresses within the strand which cause it to straighten itself.

Other objects and advantages of the invention will appear hereinafter.

A preferred embodiment of the invention selected for purposes of illustration is shown in the accompanying drawings, in which, The FIGURE is a diagrammatic illustration of a continuous steel casting machine in which the cast strand follows a curved path.

Referring to the drawing, the illustrated machine comprises a water cooled chill mold 1 having a mold passage 2 into which molten metal is poured continuously, and from which a partially solidified strand 3 is withdrawn continuously. Preferably, the mold passage is curved so that the outer solidified shell which is formed within the mold is curved as disclosed in U.S. Pat. No. 2,947,075. Alternatively, the strand may be curved after it leaves the mold as disclosed in U.S. Pat. No. 2,920,359, or by any other suitable method. The particular method of introducing curvature into the strand is not important so long as it achieves the primary purpose of reducing the required overall height of the machine.

The partially solidified curved strand follows a curved path through a secondary cooling zone indicated generally in the drawing by numeral 4, and within which the strand is supported by a plurality of rollers 5. Within the secondary cooling zone, cooling water is applied directly to both the upper and lower surfaces of the strand as by a plurality of spray nozzles 6 located at intervals along the path of the strand and arranged to direct jets of cooling water against the strand surfaces. As shown in the drawing, the strand is engaged by withdrawal rolls 7 of conventional construction as well known in the art, which said rolls control the movement of the strand through the machine.

In the typical curved strand continuous casting machine, in the absence of a bank of straightening rolls, the cast strand, after passing the withdrawal rolls, would tend to continue to move in a curved path as indicated by broken lines 8. This, of course, is not acceptable for it is necessary that the strand be straightened before it reaches the cutting station.

According to the present invention, the strand is straightened by producing a temperature differential between opposed surfaces of the strand. Thus, it will be observed that the curved strand comprises upper and lower curved surfaces 9 and 10, respectively, of different radii, the radius of curvature of the lower curved surface 10 being greater than that of the upper curved surface 9. For example, in a typical installation for casting a strand in the form of a slab having a thickness of 12 in., the radius of curvature of the lower curved surface might be 28 ft., in which case the radius of curvature of the upper surface would be 27 ft.

According to the present invention cooling water is applied to the surface which is of greater radius to cause contraction and shrinkage of the metal at and near that surface while at the same time discontinuing or substantially reducing the application of cooling water to the opposed surface, thus creating a temperature differential across the strand. Thus, as shown in the drawing, for example, the series of spray nozzles 6 which are located above the strand terminates short of the withdrawal rolls while the nozzles 11 direct cooling water against the lower curved surface at points beyond the withdrawal rolls.

As a result of the application of cooling water as above described, and the resulting temperature differential, the metal at and near the lower surface 10 is subjected to thermally induced compressive stresses, while the metal at and near the opposed upper surface 9 is in tension, due in part to the moment of force exerted by the mass of the strand beyond the straightening point acting through the strand as a lever. Once the strand is straightened, it tends to remain straight not only because of the said lever action, but also because the temperatures across the strand tend to equalize to reduce and finally eliminate the temperature differential.

Preferably, the application of cooling water to the strand within the secondary cooling zone is controlled to cause the temperature of the strand, as measured at the surfaces thereof, to be within the range of 1000° to 1800°F at the region where straightening begins. Within that range the center of the strand is still liquid or semiliquid and the bending required to straighten the strand occurs more easily than if the strand were completely solidified. The differential of temperature between the opposed surfaces of the strand should be within the range of 100° to 500°F, and preferably within the range of 200° to 300°F.

As the strand is straightened, it may be received and supported on a suitable supporting structure such as the series of rollers 12 along which the strand may be conveyed to the cutting station (not shown).

What is claimed is:

1. In the method for the continuous casting of steel strands of rectangular cross section in which the partially solidified strand emerging from a chill mold is curved and comprises upper and lower curved surfaces of different radii, and in which said strand follows a curved path through a secondary cooling zone in which the strand is additionally solidified by the direct application of cooling water thereto, the step which consists of applying cooling water to that curved surface of the strand which is of greater radius at an intensity sufficient to reduce the surface temperature of the surface of greater radius below the surface temperature of the surface of lesser radius to produce a temperature differential between the said surfaces sufficient to straighten said strand.

2. The method of claim 1 in which the temperature of the strand, as measured at the surfaces thereof, is within the range of 1000° to 1800°F at the region where the straightening begins.

3. The method of claim 1 in which said temperature differential is within the range of 100° to 500°F.

4. The method of claim 1 in which the said temperature differential is within the range of 200° to 300°F.

* * * * *